US011499113B2

(12) United States Patent
Sakata et al.

(10) Patent No.: US 11,499,113 B2
(45) Date of Patent: Nov. 15, 2022

(54) LUBRICATING OIL COMPOSITION

(71) Applicant: DIC Corporation, Tokyo (JP)

(72) Inventors: Hiroshi Sakata, Kamisu (JP); Shuujirou Ootsuki, Kamisu (JP); Takafumi Iba, Kamisu (JP)

(73) Assignee: DIC CORPORATION, Tokyo (JP)

( * ) Notice: Subject to any disclaimer, the term of this patent is extended or adjusted under 35 U.S.C. 154(b) by 0 days.

(21) Appl. No.: 17/287,660

(22) PCT Filed: Aug. 1, 2019

(86) PCT No.: PCT/JP2019/030189
§ 371 (c)(1),
(2) Date: Apr. 22, 2021

(87) PCT Pub. No.: WO2020/095489
PCT Pub. Date: May 14, 2020

(65) Prior Publication Data

US 2021/0371764 A1 Dec. 2, 2021

(30) Foreign Application Priority Data

Nov. 9, 2018 (JP) ..... JP2018-211401

(51) Int. Cl.

| | |
|---|---|
| ***C10M 135/22*** | (2006.01) |
| ***C10N 30/06*** | (2006.01) |
| ***C10N 30/08*** | (2006.01) |
| ***C10N 30/12*** | (2006.01) |
| ***C10N 40/25*** | (2006.01) |

(52) U.S. Cl.
CPC .... *C10M 135/22* (2013.01); *C10M 2219/082* (2013.01); *C10M 2219/106* (2013.01); *C10M 2223/04* (2013.01); *C10N 2030/06* (2013.01); *C10N 2030/08* (2013.01); *C10N 2030/12* (2013.01); *C10N 2040/25* (2013.01)

(58) Field of Classification Search
CPC ..... C10M 135/22; C10M 2219/082; C10M 2219/106; C10M 2223/04; C10N 2030/06; C10N 2030/08; C10N 2030/12; C10N 2040/25
See application file for complete search history.

(56) References Cited

U.S. PATENT DOCUMENTS

| | | | | |
|---|---|---|---|---|
| 4,839,069 | A | 6/1989 | Born et al. | |
| 5,294,743 | A * | 3/1994 | Sandler | C07C 319/22 568/21 |
| 2005/0113265 | A1* | 5/2005 | Yagishita | C10M 167/00 508/420 |
| 2007/0197748 | A1 | 8/2007 | Pirri et al. | |
| 2009/0062166 | A1* | 3/2009 | Hee | C10M 107/02 508/459 |
| 2010/0016189 | A1 | 1/2010 | Baker et al. | |
| 2010/0249366 | A1 | 9/2010 | Pirri et al. | |
| 2016/0215231 | A1 | 7/2016 | Iba et al. | |

FOREIGN PATENT DOCUMENTS

| | | | |
|---|---|---|---|
| CN | 105579435 | A | 5/2016 |
| EP | 0 889 030 | A1 | 1/1999 |
| JP | 63-110289 | A | 5/1988 |
| JP | 6-256296 | A | 9/1994 |
| JP | 9-188887 | A | 7/1997 |
| JP | 11-71343 | A | 3/1999 |
| JP | 2007-520535 | A | 7/2007 |
| JP | 2012-46683 | A | 3/2012 |
| JP | 2014-208854 | A | 11/2014 |

OTHER PUBLICATIONS

International Search Report dated Sep. 3, 2019, issued in counterpart International Application No. PCT/JP2019/030189 (2 pages).
Notice of Reasons for Refusal dated Oct. 27, 2020, issued in counterpart JP Patent Application No. 2020-543949, w/English translation (6 pages).

* cited by examiner

*Primary Examiner* — James C Goloboy
(74) *Attorney, Agent, or Firm* — WHDA, LLP

(57) ABSTRACT

A lubricating oil composition with high thermal stability, corrosion resistance, and extreme-pressure performance is provided. The present invention have been completed by finding that a lubricating oil composition containing a particular primary aliphatic polysulfide has excellent thermal stability and extreme-pressure performance. A lubricating oil composition containing a base oil and an additive agent, wherein an aliphatic polysulfide constitutes as an additive agent 1% to 10% by mass of the lubricating oil composition, and a primary aliphatic polysulfide constitutes 1% to 50% by mass of the aliphatic polysulfide.

4 Claims, No Drawings

LUBRICATING OIL COMPOSITION

TECHNICAL FIELD

The present invention relates to a lubricating oil composition.

BACKGROUND ART

In recent years, there has been a strong demand for automobiles with higher fuel saving and efficiency for the purpose of effective use of petroleum resources and reduction of carbon dioxide emission. Thus, there has also been a strong demand for lubricating oil compositions with higher fuel saving and efficiency for use in vehicle drive units of automobiles and industrial machines.

In general, sulfur compounds are added to lubricating oil compositions to reduce friction with metals. As their role, sulfur compounds release a certain number of sulfur radicals into lubricating oil compositions and form a low friction film on the metal surface. In recent years, also in gear oils, there has been a demand for sulfur compounds that release stable sulfur radicals in the range of low temperature to high temperature. To produce a stable number of sulfur radicals at high temperature, however, excessive sulfur radicals may be released at low temperature and cause a performance degradation problem of lubricating oils.

Improvements are required from the environmental perspective due to rusting of target metals and emission into the environment. Furthermore, a production method described in Patent Literature 1 has low yield and requires a large amount of water in the product purification (dechlorination) process. (Cited literature 1).

Sulfur atoms are easily released in applications of lubricating oils for metals. Thus, there have been undesirable corrosion problems of copper alloys used in apparatuses. (Cited literature 2).

Although a method for producing dodecanethiol as an extreme-pressure additive has been described, the production method uses a catalyst, has low productivity, and has many problems in productivity. (Cited literature 3).

CITATION LIST

Patent Literature

PTL 1: Japanese Unexamined Patent Application Publication No. 63-110289

PTL 2: Japanese Unexamined Patent Application Publication No. 11-071343

PTL 3: Japanese Unexamined Patent Application Publication (Translation of PCT Application) No. 2007-520535

SUMMARY OF INVENTION

Technical Problem

An object to be achieved by the present invention is to provide a lubricating oil composition with high thermal stability, corrosion resistance, and extreme-pressure performance.

Solution to Problem

As a result of extensive studies to achieve the above object, the present inventors have completed the present invention by finding that a lubricating oil composition containing a particular primary aliphatic polysulfide has excellent thermal stability and extreme-pressure performance.

More specifically, the present invention provides the following.

(1) A lubricating oil composition containing a base oil and an additive agent, wherein an aliphatic polysulfide constitutes as an additive agent 1% to 10% by mass of the lubricating oil composition, and a primary aliphatic polysulfide constitutes 1% to 50% by mass of the aliphatic polysulfide.

(2) The lubricating oil composition, wherein the aliphatic polysulfide further contains at least one aliphatic polysulfide selected from secondary aliphatic polysulfides and tertiary aliphatic polysulfides in addition to the primary aliphatic polysulfide.

(3) The lubricating oil composition, wherein the primary aliphatic polysulfide contains 70% or more of a primary aliphatic polysulfide with a sulfur chain length in the range of 1 to 4.

Advantageous Effects of Invention

The present invention can provide a lubricating oil composition that can satisfy lubricity, corrosion resistance, and heat resistance.

DESCRIPTION OF EMBODIMENTS

The present invention is described in detail below.

[Lubricating Oil Composition]

A lubricating oil composition according to the present invention is a lubricating oil composition containing a base oil and an additive agent, wherein an aliphatic polysulfide constitutes as an additive agent 1% to 10% by mass of the lubricating oil composition, and a primary aliphatic polysulfide constitutes 1% to 50% by mass of the aliphatic polysulfide.

[Base Oil]

A lubricating oil composition according to the present invention contains a base oil. The base oil may be a mineral oil or a synthetic oil.

The mineral oil may be an atmospheric residue produced by atmospheric distillation of a paraffin base, naphthene base, or intermediate base crude oil; a distillate oil produced by vacuum distillation of the atmospheric residue; or a mineral oil produced by purifying the distillate oil by at least one of solvent deasphalting, solvent extraction, hydrocracking, solvent dewaxing, catalytic dewaxing, or hydrorefining, for example, light neutral oil, medium neutral oil, heavy neutral oil, bright stock, or a mineral oil produced by isomerizing a wax (GTL wax) produced by the Fischer-Tropsch process.

The mineral oil may be a Group 1, 2, or 3 mineral oil of the base oil category of the American Petroleum Institute (API) and is preferably a Group 2 or 3 mineral oil to further suppress sludge formation and to ensure stability with respect to viscosity characteristics, oxidative degradation, and the like.

Examples of the synthetic oil include poly-α-olefins, such as polybutene, ethylene-α-olefin copolymers, α-olefin homopolymers and copolymers; various ester oils, such as polyol esters, dibasic acid esters, and phosphate esters; various ethers, such as polyphenyl ethers; polyglycols; alkylbenzenes; and alkylnaphthalenes.

The base oil may be the mineral oil alone or a combination of two or more of the mineral oils or may be used in combination with one or more of the synthetic oils.

The base oil may have any viscosity and from the perspective of an appropriate viscosity preferably has a kinematic viscosity of 1 $mm^2/s$ or more, more preferably 1.5 $mm^2/s$ or more, still more preferably 2 $mm^2/s$ or more, at 100° C. The upper limit is preferably 50 $mm^2/s$ or less, more preferably 40 $mm^2/s$ or less, still more preferably 30 $mm^2/s$ or less. In the present specification, the kinematic viscosity is measured with a glass capillary viscometer in accordance with JIS K 2283: 2000. A base oil with a kinematic viscosity and a viscosity index in the above ranges is more suitable for a lubricating oil composition for transmissions and has improved anti-seizing properties and copper corrosion resistance.

The base oil content based on the total amount of the composition should be appropriate and is typically 50% or more by mass, preferably 60% or more by mass, more preferably 65% or more by mass, still more preferably 70% or more by mass, from the perspective of improved anti-seizing properties and copper corrosion resistance. The upper limit is preferably 97% or less by mass, more preferably 95% or less by mass, still more preferably 93% or less by mass.

[Additive Agent]

A lubricating oil composition according to the present invention characteristically contains an aliphatic polysulfide. Without the aliphatic polysulfide, a lubricating oil composition according to the present invention cannot satisfy desired anti-seizing properties. The addition of an aliphatic polysulfide, however, accelerates metal corrosion. In particular, to improve the anti-seizing properties, the sulfur content of the aliphatic polysulfide is often increased to increase the sulfur chain length of the polysulfide. This increases the number of released sulfur radicals but tends to generate sulfur radicals even at low temperature, often resulting in higher corrosiveness. On the other hand, it is known that the thermal stability of an aliphatic polysulfide is also greatly influenced by the number of carbon atoms that bind to a carbon atom to which sulfur binds. Heat resistance is highest in the primary form with one bonded carbon atom and lowest in the tertiary form with three bonded carbon atoms. The number of released sulfur radicals also increases and decreases accordingly. Thus, it was found that in addition to the sulfur content the structure of carbon bonded to sulfur can be modified in an appropriate range to appropriately adjust the number of released sulfur radicals. Primary polysulfides have high heat resistance, and a mixture of primary polysulfides have higher performance than that assumed from the sum of the performance of each primary polysulfide. For example, even a small amount of the mixture could greatly improve anti-seizing properties.

Aliphatic polysulfides are sulfur-containing compounds represented by the formula 1.

$$C_xH_{(2x+1)}—S_y—C_zH_{(2z+1)} \quad (1)$$

In the formula (1), x and z denote 2 to 24. X and z may be the same or different and are preferably the same from the perspective of production.

A polysulfide mixture containing two or more different aliphatic polysulfides may also be used. An aliphatic polysulfide having 1 to 10 carbon atoms preferably constitutes 50% or more, more preferably 70% or more, still more preferably 85% or more, of the polysulfide mixture. Most preferably, the polysulfide mixture is composed entirely of aliphatic polysulfides having 1 to 10 carbon atoms.

A polysulfide mixture containing two or more aliphatic polysulfides having different y's in the range of 1 to 8 in the formula (1) may also be used. An aliphatic polysulfide with a sulfur chain length in the range of 1 to 4 preferably constitutes 70% or more, more preferably 85% or more, of the polysulfide mixture. Most preferably, the polysulfide mixture is composed entirely of aliphatic polysulfides with a sulfur chain length in the range of 1 to 4.

Aliphatic polysulfides include primary, secondary, and tertiary polysulfides based on the structure of $C_xH_{(2x+1)}$ and $C_zH_{(2z+1)}$.

The primary polysulfide may be diethyl polysulfide, di-n-butyl polysulfide, di-n-hexyl polysulfide, di-n-octyl polysulfide, di-n-nonyl polysulfide, di-n-dodecyl polysulfide, or di-n-octadecyl polysulfide.

The secondary polysulfide may be bishex-2-yl polysulfide, bisoct-2-yl polysulfide, bisdec-2-yl polysulfide, or bisdodec-2-yl polysulfide.

The tertiary polysulfide may be bis-2-methyleth-2-yl polysulfide, bis-2-methylpent-2-yl polysulfide, bis-2-methylhept-2-yl polysulfide, bis-2-methylnon-2-yl polysulfide, or bis-2-methylundec-2-yl polysulfide.

The primary polysulfide content of the aliphatic polysulfide in the lubricating oil composition is preferably 1% or more, more preferably 10% or more, still more preferably 30% or more, from the perspective of performance improvement effect. A primary polysulfide content of more than 50%, however, results in excessively high heat resistance and performance degradation. The primary polysulfide content is therefore preferably 50% or less, more preferably 45% or less.

Any aliphatic polysulfide that satisfies the above requirements may be used in a lubricating oil composition according to the present invention. It is particularly preferable to use an aliphatic polysulfide containing 70% or more of a primary polysulfide with a sulfur chain length in the range of 1 to 4.

The aliphatic polysulfide that can be used in a lubricating oil composition according to the present invention may be a mixture of the primary, secondary, and tertiary polysulfides described above or a mixture of polysulfides of different carbon chains. Examples include n-butyl-2-methyl-2-yl polysulfide, n-octyl-2-methylpentyl-2-yl polysulfide, hex-2-yl-2-methylpent-2-yl polysulfide, and n-dodecyl-2-methylundec-2-yl polysulfide. These compounds may be produced by any method, may be synthesized by a traditional method, and are preferably produced without chlorine impurities from the perspective of corrosion control. From the perspective of economic efficiency, appearance, and odor, it is preferable to mainly use a polysulfide synthesized from olefin, sulfur, hydrogen sulfide, and the like.

Aliphatic polysulfides for use in a lubricating oil composition according to the present invention may be used alone or in combination. Secondary polysulfides have higher thermal stability than tertiary polysulfides. Thus, a combination of a primary polysulfide and a secondary polysulfide or a combination of a primary polysulfide, a secondary polysulfide, and a tertiary polysulfide, rather than a combination of a primary polysulfide and a tertiary polysulfide, can cause continuous thermal decomposition and is preferred. Although the ratio of a secondary polysulfide to a tertiary polysulfide is not particularly limited, a higher ratio of the tertiary polysulfide results in significantly lower thermal stability. Thus, the ratio of the tertiary polysulfide to the secondary and tertiary polysulfides is preferably 50% or less.

In the present invention, the aliphatic polysulfide constitutes 1% to 10% by mass, preferably 1% to 8% by mass, more preferably 1% to 5% by mass, of the lubricating oil composition. When the aliphatic polysulfide content of the lubricating oil composition is less than 1% by mass, the intended anti-seizing performance cannot be obtained. When the aliphatic polysulfide content is more than 10% by mass, the number of sulfur radicals is excessively increased while heating, and the corrosion resistance deteriorates.

A lubricating oil composition according to the present invention is not particularly limited, provided that the lubricating oil composition contains a base oil and an aliphatic polysulfide. For example, the following additive agents may be used in combination depending on the intended use and performance: an oiliness agent, an anti-wear agent, an extreme-pressure agent, another anticorrosive, a corrosion inhibitor, an antifoaming agent, a cleaning/dispersing agent, a pour-point depressant, a viscosity index improver, an antioxidant, an emulsifier, a demulsifier, a fungicide, a friction modifier, and a surfactant.

The following are specific examples of various additive agents. Examples of the oiliness agent include long-chain fatty acids (oleic acid). Examples of the anti-wear agent include phosphorus compounds, such as phosphate esters and metal dithiophosphate salts. Examples of the extreme-pressure agent include organosulfur compounds and organic halides. Examples of the other anticorrosive include carboxylic acids, amines, alcohols, and esters. Examples of the corrosion inhibitor include nitrogen compounds (benzotriazole etc.) and compounds containing sulfur and nitrogen (1,3,4-thiadiazolyl-2,5-bisdialkyldithiocarbamate).

Examples of the antifoaming agent include silicone oil and metallic soaps. Examples of the cleaning/dispersing agent include neutral and basic metal sulfonates and phenates (metal salt forms), succinimides, esters, and benzylamine copolymers. Examples of the pour-point depressant include condensates of chlorinated paraffin and naphthalene or phenol, polyalkyl acrylates and methacrylates, polybutene, polyalkylstyrenes, and poly(vinyl acetate). Examples of the viscosity index improver include polymethacrylates, polyisobutylene, olefin copolymers, and polyalkylstyrenes. Examples of the antioxidant include amines, hindered phenols, zinc thiophosphate, and trialkylphenols. Examples of the emulsifier include salts and esters of sulfuric acid, sulfonic acid, and phosphoric acid, fatty acid derivatives, amine derivatives, quaternary ammonium salts, and polyoxyethylene activators. Examples of the demulsifier include quaternary ammonium salts and sulfonated oils. Examples of the fungicide include phenolic compounds, formaldehyde donor compounds, and salicylanilide compounds.

A lubricating oil composition according to the present invention is a uniform mixture of a base oil, an aliphatic polysulfide, and another additive agent, which are blended by any method. The mixture may be heated in the temperature range of 30° C. to 60° C. for homogenization.

A lubricating oil composition according to the present invention may be used in any application, for example, as a lubricant composition, as an automotive lubricating oil for use in internal combustion engines, driving equipment, such as automatic transmissions, buffers, and power steering, and gears, as a metalworking fluid for use in metalworking, such as cutting, grinding, and plastic working, or as a hydraulic fluid, which is a power transmission fluid for use in power transmission, force control, and buffer operations in hydraulic systems, such as hydraulic machines and equipment. In particular, when used as a gear oil, a lubricating oil composition according to the present invention can cause a lower degree of swelling of a sealant (chloroprene rubber, nitrile rubber, etc.) in a gear box than conventional products and can therefore be suitably used in applications including contact with the sealant.

[Other Additive Agents]

A lubricating oil composition according to the present invention may contain another commonly used additive agent as required without losing the advantages of the present invention.

Examples of such another additive agent include oiliness agents, anti-wear agents, extreme-pressure agents, anticorrosives, corrosion inhibitors, viscosity index improvers, antioxidants, metal-based cleaners, dispersants, and antifoaming agents.

Examples of the oiliness agents include long-chain fatty acids (oleic acid). Examples of the anti-wear agents include phosphate esters and metal dithiophosphate salts. Examples of the extreme-pressure agents include organosulfur compounds, such as sulfurized fats and oils and sulfurized esters, organic halides, phosphate esters, acidic phosphate esters, and amine neutralized products thereof. Examples of the other anticorrosives include carboxylic acids, amines, alcohols, and esters. Examples of the corrosion inhibitors include nitrogen compounds (benzotriazole etc.) and compounds containing sulfur and nitrogen (1,3,4-thiadiazolyl-2,5-bisdialkyldithiocarbamate and 2,5-bis(alkyldithio)-1,3,4-thiadiazole). Examples of the viscosity index improvers include polymers, including poly(meth)acrylates, such as polymers and copolymers of (meth)acrylates, such as alkyl (meth)acrylates, olefin polymers, such as ethylene-propylene copolymers and polybutylene, and styrene polymers, such as polyalkylstyrenes, styrene-diene copolymers, and styrene-isoprene copolymers. Examples of the antioxidants include amine antioxidants, such as diphenylamine antioxidants and naphthylamine antioxidants, and phenolic antioxidants, such as monophenolic antioxidants, diphenolic antioxidants, and hindered phenolic antioxidants.

Examples of the metal-based cleaners include metal sulfonates, metal phenates, and metal salicylates, and examples of the metal include alkali metals, such as sodium and potassium, and alkaline-earth metals, such as magnesium, calcium, and barium.

Examples of the dispersants include dispersants other than the succinimide dispersants, for example, ashless dispersants, such as benzylamines, boron-containing benzylamines, succinate esters, and monovalent and divalent carboxylic acid amides exemplified by fatty acids and succinic acid.

Examples of the antifoaming agents include silicone oil, fluorosilicone oil, and fluoroalkyl ethers.

In addition to the other additive agents, a lubricating oil composition according to the present invention may contain a pour-point depressant, an anti-wear agent, an extreme-pressure agent, a friction modifier, an anticorrosive, and a metal deactivator. A compound with a plurality of functions of the other additive agents (for example, a compound with functions of an anti-wear agent and an extreme-pressure agent) may also be used. In particular, a phosphorus compound used as an extreme-pressure agent or an anti-wear agent, for example, a phosphate ester, is expected to improve the extreme-pressure performance of sulfur-based additive agents.

A commercially available additive agent package containing a plurality of additive agents may also be used as the other additive agent.

In the present invention, the other additive agents may be used alone or in combination.

The other additive agent content can be appropriately adjusted in accordance with the type of additive agent without losing the advantages of the present invention. When another additive agent is contained, the other additive agent content ranges typically from 0.01% to 15% by mass, preferably 0.05% or more by mass, more preferably 0.1% or more by mass, still more preferably 0.3% or more by mass, particularly preferably 0.5% or more by mass, of the total amount of the composition. The upper limit is preferably 15% or less by mass, more preferably 12% or less by mass, still more preferably 10% or less by mass.

[Method for Producing Lubricating Oil Composition]

A lubricating oil composition according to the present invention may be produced by any method, for example, by a method including the step of mixing a base oil with the above aliphatic polysulfide.

If necessary, a viscosity index improver or a corrosion inhibitor may be added together with the above other additive agents for lubricating oils.

In the above step, matters relating to the base oil and the aliphatic polysulfide are as described above, and suitable components and component contents are also as described above.

The viscosity index improver may be added in the form of a solution containing a resin component of the viscosity index improver dissolved in a diluent oil. The solution typically has a resin concentration in the range of 10% to 50% by mass. The components added are preferably stirred and uniformly dispersed by a known method.

[Various Physical Properties of Lubricating Oil Composition]

A lubricating oil composition according to the present invention preferably has a kinematic viscosity of 1.5 $mm^2/s$ or more, more preferably 5 $mm^2/s$ or more, still more preferably 50 $mm^2/s$ or more, at 100° C. The upper limit is preferably 30 $mm^2/s$ or less, more preferably 20 $mm^2/s$ or less. A kinematic viscosity in the above range is more suitable for a lubricating oil composition for transmissions and results in improved anti-seizing properties and copper corrosion resistance.

The weld load of a lubricating oil composition according to the present invention in the Shell four-ball test is preferably 3000 N or more, more preferably 4000 N or more, still more preferably 4500 N or more. The weld load in the Shell four-ball test is measured by a method described in the examples. As described above, a lubricating oil composition for transmissions according to the present invention has a high weld load in the Shell four-ball test and has good anti-seizing properties.

[Applications of Lubricating Oil Composition]

As described above, a lubricating oil composition according to the present invention has good anti-seizing properties and copper corrosion resistance and is suitably used for lubrication of transmissions for automobiles, such as gasoline cars, hybrid vehicles, and electric vehicles, transmissions for construction, agricultural, and civil engineering machines, and industrial machine drive units. The lubricating oil composition for drive units according to the present invention has good copper corrosion resistance and is therefore suitably used in hybrid vehicles and electric vehicles equipped with electrical components, such as electric motors and electric generators, particularly in transmissions for hybrid vehicles and electric vehicles in which electric motors are cooled by oil. The transmissions may be manual transmissions, automatic transmissions, or continuously variable transmissions. Although a lubricating oil composition according to the present invention is used for mechanical drive units, such as transmissions, the lubricating oil composition may also be used in applications other than the mechanical drive units, for example, gasoline engines, diesel engines, other internal combustion engines, automotive gears, other industrial gears for general machinery, and machines equipped with a body bearing or a rolling bearing, such as hydraulic machines, turbines, compressors, machine tools, and cutting machines.

EXAMPLES

The present invention is further described in the following examples. However, the present invention is not limited to these examples.

Examples 1 to 11, Comparative Examples 1 to 5

Lubricating oil compositions were prepared using the formulations (% by mass) listed in Table 1. The additive agents and the base oil may be added in any order by any method. The additive agents may be added to the base oil, or a mixture of the additive agents prepared in advance may be added to the base oil. In particular, when a mixture of the additive agents is prepared in advance, the phosphorus compound is preferably added lastly to suppress side reactions. The lubricating oil compositions were tested by the following methods to evaluate their physical properties. Table 1 shows the evaluation results.

[Sulfur Content]

The sulfur content of the aliphatic polysulfide was measured by JIS K 2541-7 Crude oil and petroleum products—Determination of sulfur content Part 7: Wavelength-dispersive X-ray fluorescence method (calibration curve method).

The contents of various sulfur chain lengths of the aliphatic polysulfide were determined by high-performance liquid chromatography. Specific conditions are described below.

<HPLC Measurement Conditions>

Measuring apparatus: LC-06A manufactured by Shimadzu Corporation

Column: INTERSIL-C8 4.5 μm 250 mm×4.6 mm

Detector: UV 210 nm

Eluent: acetonitrile/water (volume ratio)=85/15, flow rate 1 ml/min

[Weld Load]

The weld load was measured in the Shell four-ball test. Specific conditions are described below.

Experimental method: ASTM D2596. Carbon steel balls with a diameter of ½ inches are used as test balls. The test balls are rotated at 1770 rpm. The load at which test balls fuse together is recorded as the weld load.

[Heat Resistance]

The thermal decomposition curve was measured by thermogravimetric analysis (TGA), and the 50% thermal decomposition temperature was adopted as the heat resistance temperature.

Measuring apparatus: Thermoplus EVO2 TG-DTA manufactured by Rigaku Corporation

Measurement conditions: measurement range room temperature to 500° C., heating rate 5° C./min

[Copper Sheet Corrosion]

Copper sheet corrosion was measured by JIS K 2513 Petroleum Products—Corrosiveness to copper—Copper strip test. The measurement temperature was 121° C., and the measurement time was 3 hours.

TABLE 1

| | | | | Example 1 | Example 2 Polysulfide 1 | Example 3 | Example 4 Polysulfide 2 | Example 5 Polysulfide 3 | Example 6 Polysulfide 4 | Example 7 Polysulfide 5 | Example 8 | Example 9 Polysulfide 6 | Example 10 | Example 11 Polysulfide 7 | Comparative example 1 Polysulfide 8 | Comparative example 2 | Comparative example 3 Polysulfide 9 | Comparative example 4 Polysulfide 10 | Comparative example 5 Polysulfide 1 |
|---|---|---|---|---|---|---|---|---|---|---|---|---|---|---|---|---|---|---|---|
| Composition | Additive amount of polysulfide (%) | | | 5 | 10 | 5 | 5 | 5 | 5 | 5 | | 5 | | 5 | 5 | | 5 | 5 | 15 |
| | Physical properties of polysulfide | Primary | | 33 | 33 | 33 | 45 | 1 | 33 | 10 | | 1 | | 33 | 60 | | 0 | 33 | 33 |
| | | Primary structure | Sulfur chain length 1-4 | 100 | 100 | 100 | 100 | 100 | 70 | 90 | | 90 | | 70 | 100 | | | 50 | 100 |
| | | | Sulfur chain length of 5 or more | 0 | 0 | 0 | 0 | 0 | 0 | 10 | | 10 | | 30 | 0 | | | 50 | 0 |
| | | | Carbon chain length of C10 or less | 100 | 100 | 100 | 100 | 100 | 100 | 100 | | 100 | | 0 | 100 | | | 100 | 100 |
| | | | Carbon chain length of C11 or more | 0 | 0 | 0 | 0 | 0 | 0 | 0 | | 0 | | 100 | 0 | | | 0 | 0 |
| | | Branched (secondary, tertiary) | | 67 | 67 | 67 | 55 | 99 | 67 | 90 | | 99 | | 67 | 40 | | 100 | 67 | 67 |
| | | Secondary and tertiary structures | Sulfur chain length 1-4 | 85 | 85 | 85 | 85 | 85 | 85 | 90 | | 90 | | 85 | 85 | | 85 | 50 | 85 |
| | | | Sulfur chain length of 5 or more | 15 | 15 | 15 | 15 | 15 | 15 | 10 | | 10 | | 15 | 15 | | 15 | 50 | 15 |
| | | | Carbon chain length of C10 or less | 50 | 50 | 50 | 50 | 50 | 50 | 100 | | 100 | | 50 | 50 | | 50 | 50 | 50 |
| | | | Carbon chain length of C11 or more | 50 | 50 | 50 | 50 | 50 | 50 | 0 | | 0 | | 50 | 50 | | 50 | 50 | 50 |
| | Additive amount of corrosion inhibitor (%) | Dioctyl dilthiothiadiazole | | 0.5 | 0.5 | 0.5 | 0.5 | 0.5 | 0.5 | 0.5 | | 0.5 | | 0.5 | 0.5 | | 0.5 | 0.5 | 0.5 |
| | Additive amount of anti-wear agent (%) | Nonyl phosphoric ester | | 0 | 0 | 0.15 | 0 | 0 | 0 | 0 | 0.15 | 0 | 0.15 | 0 | 0 | 0.15 | 0 | 0 | 0 |
| | Additive amount of base oil (%) | Mineral oil 150N | | 95 | 90 | 92 | 95 | 95 | 95 | 95 | 92 | 95 | 92 | 95 | 95 | 92 | 95 | 95 | 85 |
| | Total | | | 100.5 | 100.5 | 97.65 | 100.5 | 100.5 | 100.5 | 100.5 | 92.65 | 100.5 | 92.65 | 100.5 | 100.5 | 92.65 | 100.5 | 100.5 | 100.5 |
| Characteristics | Sulfur characteristics | Sulfur content | | 25 | 25 | 25 | 22 | 22 | 27 | 46 | | 44 | | 19 | 15 | | 22 | 28 | 28 |
| | Heat resistance | Thermogravimetric analysis (50% thermal decomposition temperature ° C.) | | | 243 | | 255 | 235 | 245 | 219 | | 210 | | 265 | 247 | | 230 | 240 | 243 |

TABLE 1-continued

| | | Example 1 | Example 2 Polysulfide 1 | Example 3 | Example 4 Polysulfide 2 | Example 5 Polysulfide 3 | Example 6 Polysulfide 4 | Example 7 Polysulfide 5 | Example 8 | Example 9 Polysulfide 6 | Example 10 | Example 11 Polysulfide 7 | Comparative example 1 Polysulfide 8 | Comparative example 2 | Comparative example 3 Polysulfide 9 | Comparative example 4 Polysulfide 10 | Comparative example 5 Polysulfide 1 |
|---|---|---|---|---|---|---|---|---|---|---|---|---|---|---|---|---|---|
| Copper sheet composition | 121° C. 3 hr | 1b | 1b | 1b | 1b | 1b | 1b | 1b | 1b | 1b | 1b | 1b | 1b | 1b | 1b | 3b | 3a |
| Weld load | ASTM D2591 (N) | 4000 | 7000 | 6000 | 3500 | 3500 | 4200 | 7500 | 9000 | 6000 | 6500 | 6500 | 2500 | 2700 | 2800 | 4000 | 7200 |

The invention claimed is:

1. A lubricating oil composition comprising:

a base oil;

a corrosion inhibitor; and an aliphatic polysulfide represented by formula (1) in an amount of 1% to 10% by mass of the lubricating oil composition, the aliphatic polysulfide comprising a primary aliphatic polysulfide in an amount of 10% to 50% by mass of the aliphatic polysulfide, $$C_xH_{(2x+1)}—S_y—C_zH_{(2z+1)} \quad (1),$$

wherein in the formula (1), x and z denote 1 to 10, and y is 1 to 8, wherein the primary aliphatic polysulfide consists of 70% by mass to 90% by mass of the primary aliphatic polysulfide in which y is 1 to 4, and 10% by mass to 30% by mass of the primary aliphatic polysulfide in which y is 5 to 8, wherein in the primary aliphatic polysulfide, each of a portion of $C_xH_{(2x+1)}$— and a portion of —$C_zH_{(2z+1)}$ in the formula (1) is a primary alkyl group.

2. The lubricating oil composition according to claim 1, wherein the aliphatic polysulfide further contains at least one aliphatic polysulfide selected from secondary aliphatic polysulfides and tertiary aliphatic polysulfides in addition to the primary aliphatic polysulfide, wherein in the secondary aliphatic polysulfide, each of a portion of $C_xH_{(2x+1)}$— and a portion of —$C_zH_{(2z+1)}$ in the formula (1) is a secondary alkyl group, wherein in the tertiary aliphatic polysulfide, each of a portion of $C_xH_{(2x+1)}$— and a portion of —$C_zH_{(2z+1)}$ in the formula (1) is a tertiary alkyl group.

3. The lubricating oil composition according to claim 1, wherein the corrosion inhibitor is selected from the group consisting of benzotriazole, 1,3,4-thiadiazolyl-2,5-bisdialkyldithiocarbamate, and dioctyl dithiothiadiazole.

4. The lubricating oil composition according to claim 1, wherein the lubricating oil composition consists of:

the base oil;

the corrosion inhibitor; and the aliphatic polysulfide.

* * * * *